US005875618A

United States Patent [19]

Sodies et al.

[11] Patent Number: 5,875,618

[45] Date of Patent: Mar. 2, 1999

[54] HAND-HELD DEVICE FOR BUNDLING ELONGATED OBJECTS

[75] Inventors: Jörg Sodies, Hünfeld; Hartmuth Kiel, Burghaun, both of Germany

[73] Assignee: Wella Aktiengesellschaft, Darmstadt, Germany

[21] Appl. No.: 955,071

[22] Filed: Oct. 21, 1997

[30] Foreign Application Priority Data

Oct. 28, 1996 [DE] Germany ..... 196 44 753.4

[51] Int. Cl.[6] ..... B65B 27/10; B65B 13/14

[52] U.S. Cl. ..... 53/586; 53/582; 53/587; 53/590; 53/592; 156/468

[58] Field of Search ..... 53/583, 137.2, 53/139.1, 586, 590, 587; 100/27; 156/468

[56] References Cited

U.S. PATENT DOCUMENTS

| | | | |
|---|---|---|---|
| 2,833,438 | 5/1958 | Anderson | 156/468 |
| 3,048,953 | 8/1962 | Casey | 53/586 |
| 3,418,358 | 12/1968 | Sejda | 156/468 |
| 3,547,737 | 12/1970 | Vici . | |
| 4,030,407 | 6/1977 | Jesty et al. | 53/587 X |
| 4,264,398 | 4/1981 | Pruitt | 156/468 |

FOREIGN PATENT DOCUMENTS 195 32 487
A1 3/1997 Germany .

*Primary Examiner*—Linda Johnson
*Attorney, Agent, or Firm*—Michael J. Striker

[57] ABSTRACT

The electrically-powered hand-held device for bundling elongated objects by wrapping the elongated objects with a one-side adhesive band includes a handle, a rotatable bundling head connected to the handle and including a device for pressing the band against the elongated objects and for pulling it tightly around the elongated objects and a device for rotating the band together with the bundling head around the elongated objects. The device for pressing and pulling includes a spring-loaded displaceable central jaw located in the bundling head and first and second spring-loaded turning jaws opposite one another with the central jaw between them in the bundling head. The central jaw is displaceable by insertion of the elongated objects into the bundling head and the spring-loaded turning jaws are formed and positioned in the bundling head so that the spring-loaded turning jaws engage the band on opposite sides of the band and slid over controlling slid surfaces provided on the displaceable central jaw to wrap and tighten the band around the objects.

6 Claims, 4 Drawing Sheets

HAND-HELD DEVICE FOR BUNDLING ELONGATED OBJECTS

BACKGROUND OF THE INVENTION

The present invention relates to a bundling device for bundling elongated objects and, more particularly, to a hand-held device for bundling elongated objects.

Bundling devices of the above-mentioned general type are known in the art. One of such bundling devices is disclosed for example in the U.S. Pat. No. 3,547,737. The bundling head of this bundling device disclosed in this reference has the disadvantage that a tight wrapping with an adhesive band around elongated objects is not possible since pressure forces act on the band. It is believed to be clear that it is therefore advisable to improve the existing bundling heads.

SUMMARY OF THE INVENTION

Accordingly, it is an object of the present invention to provide a bundling head for bundling elongated objects, which avoids the disadvantages of the prior art.

In keeping with this object and with others which will become apparent hereinafter, one feature of present invention resides, briefly stated, in a bundling head for bundling elongated objects, in which a bundle wrapping of the objects is performed by an axial rotation of a band, which is adhesive on one side, around the objects, and a pressing device is provided for pressing the band to the object, wherein in accordance with the present invention, a band pulling device is arranged inside the bundling device.

When the bundling head is designed in accordance with present invention, it eliminates the disadvantages of the prior art, and provides for highly advantageous results.

In accordance with another feature of present invention, the band pulling device includes two opposite turning jaws which are controlled by a central, spring-biased displacing jaw, so that during insertion of the object the displacement jaw is displaced into the head and as a result the above mentioned two jaws press against the band from opposite sides.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 5:
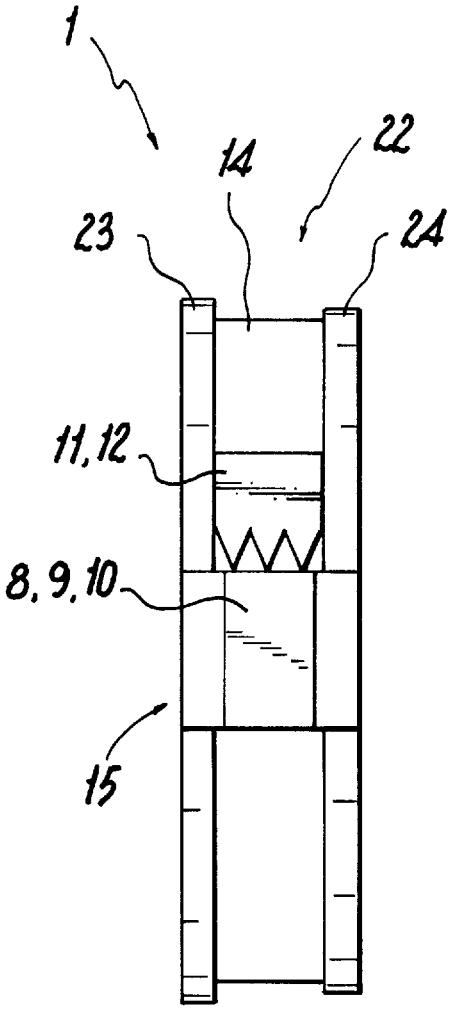
FIG. 5 is a plan view of the bundling head in accordance with the present invention.
Figure 6:
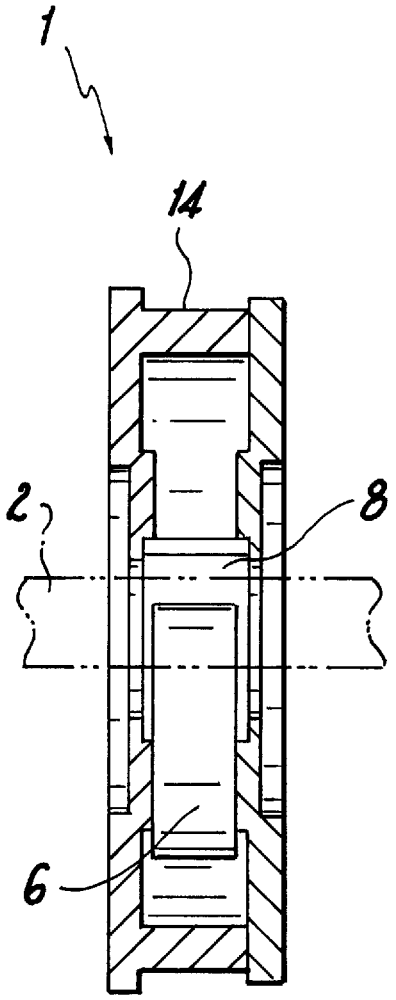
FIG. 6 is a view showing a section of the inventive bundling head taken along the line VI—VI in FIG. 2.
Figure 7:
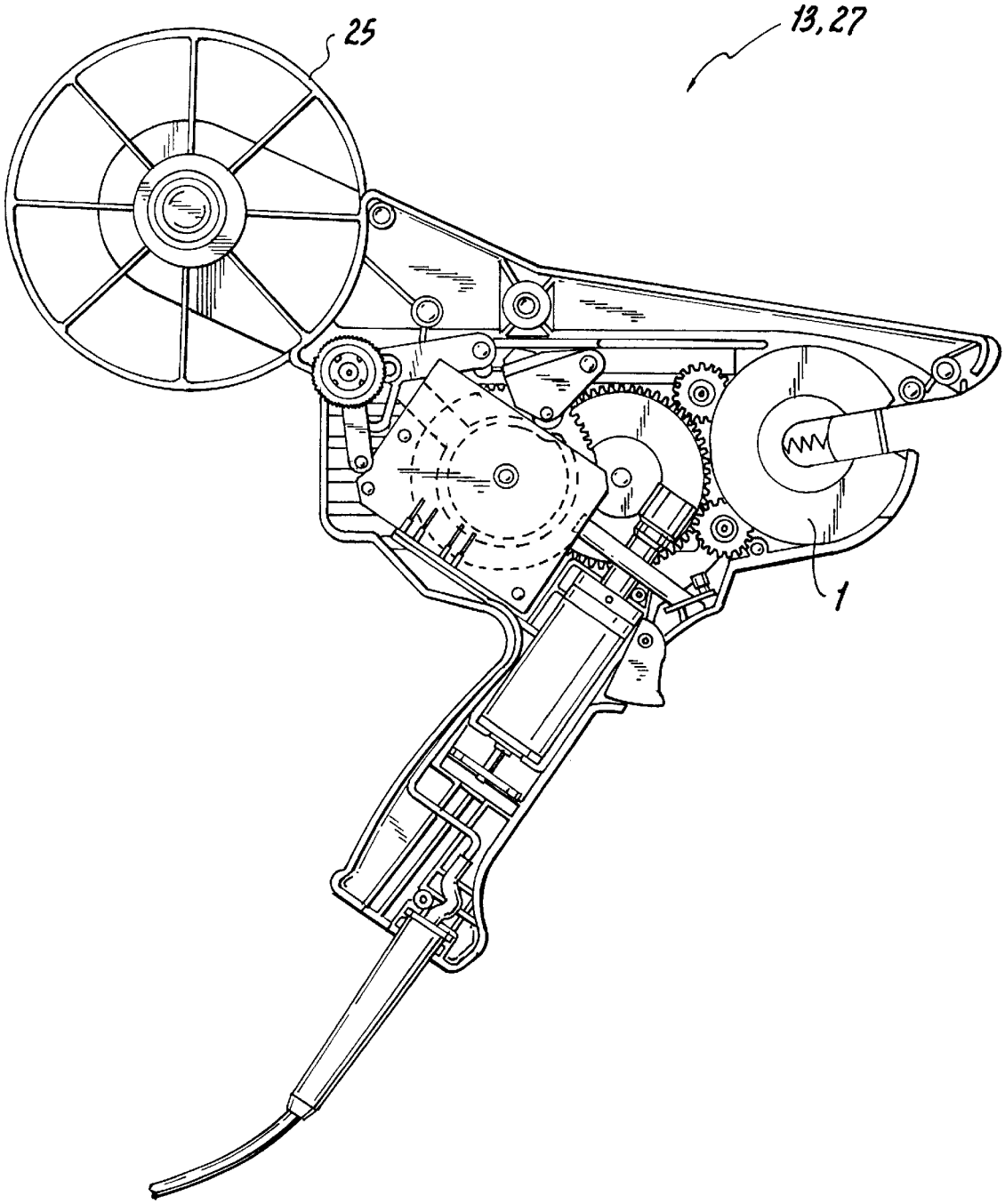
FIG. 7 is a side view of the hand-held bundling device according to the invention.

A hand-held device for bundling elongated objects 2, for example cables, is shown in FIG. 7 and includes the bundling head 1, which is shown in detail in FIGS. 1 to 6. The device 27 makes a wrapped bundle of objects 2 by an axial rotation around the objects 2 by means of a one-side adhesive band 3. A pressing device 4 is provided for pressing the band 3 against the objects 2.

A band pulling device 5 is arranged inside the bundling head 1. The bundling head 1 is axially rotatable by means of a toothed gear 14. The toothed gear 14 together with the bundling head 1 has an opening 15 for insertion of the elongated objects 2 into the bundling head 1.

The band pulling device 5 has two oppositely located turning jaws 6 and 7. They are controlled by a displacing jaw 8 which is arranged centrally between the first and second jaws 6, 7 and is spring-loaded by a pressure spring 16. During insertion of the object 2 through the opening 15 into the bundling head 1 the displacing jaw 8 is displaced further into the bundling head 1. The turning jaws 6 and 7 are formed so that they press against the band 3 from opposite sides and therefore provide a clamping pull on the band 3 located therebetween that is, they act to increase band tension in a manner controlled by the displacing jaw 8.

The turning jaws 6, 7 are each provided with a leg spring 17, 18 and are each controlled by an appropriately shaped slide surfeace or groove 19, 20 on the displacement jaw 8. When the objects 2 and the initial portion of the band 3' with the adhesive side 21 are brought in contact as shown in a broken line, the objects 2 together with the band 3 are pressed through the opening 15 to the rubber like layer 10 of the displacing jaw 8. Thereby the band 3 is connected in the region of the contact point of the displacing jaw 8 with the objects 2.

Figure 1:
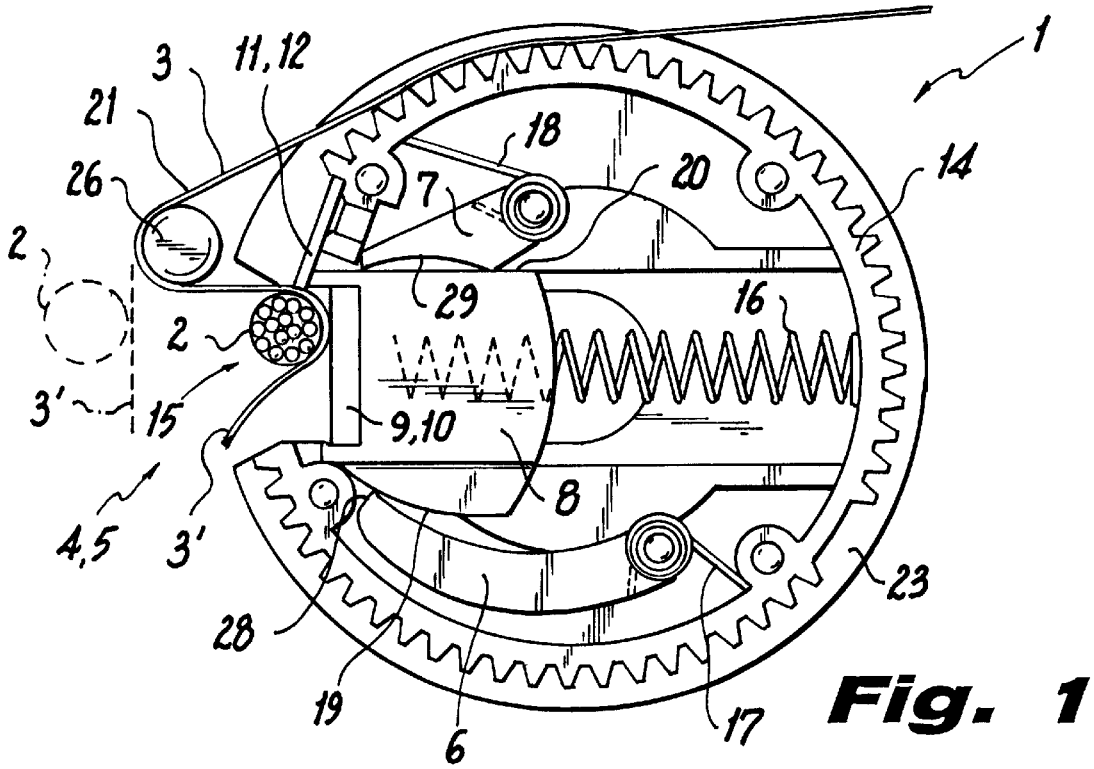
FIG. 1 is a side view of a bundling head in a first initial position, in a bundling device in accordance with present invention.
Figure 2:
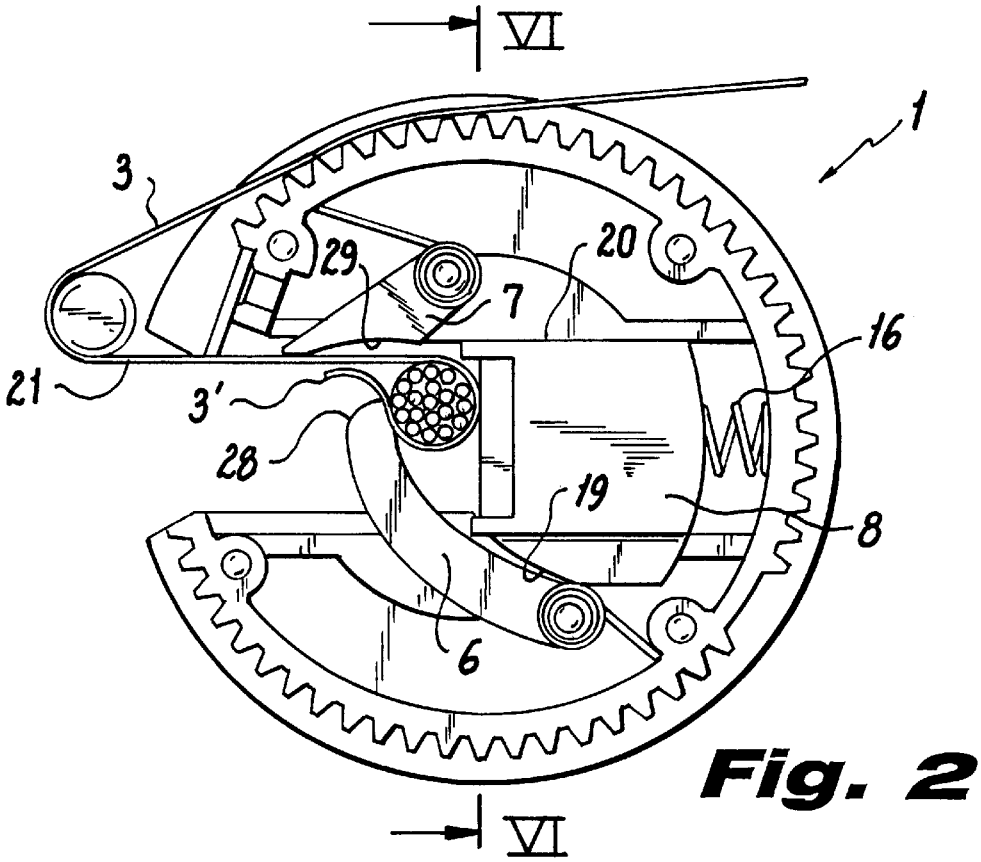
FIG. 2 is a side view of the inventive bundling head in a second position.

During further insertion of the objects 2 into the bundling head 1 against the force of the pressure spring 16, the displacing jaw 8 is displaced to a second position shown in FIG. 2. The first turning jaw 6 presses approximately on an opposite point of the band 3 against the objects 2 by means of the leg spring 17. The second turning jaw 7 is held in the upper position by a fixedly clamped adhesive band 3 (for example by means of a braking device 6 disclosed in the German patent document DE 195 32 487).

Figure 3:
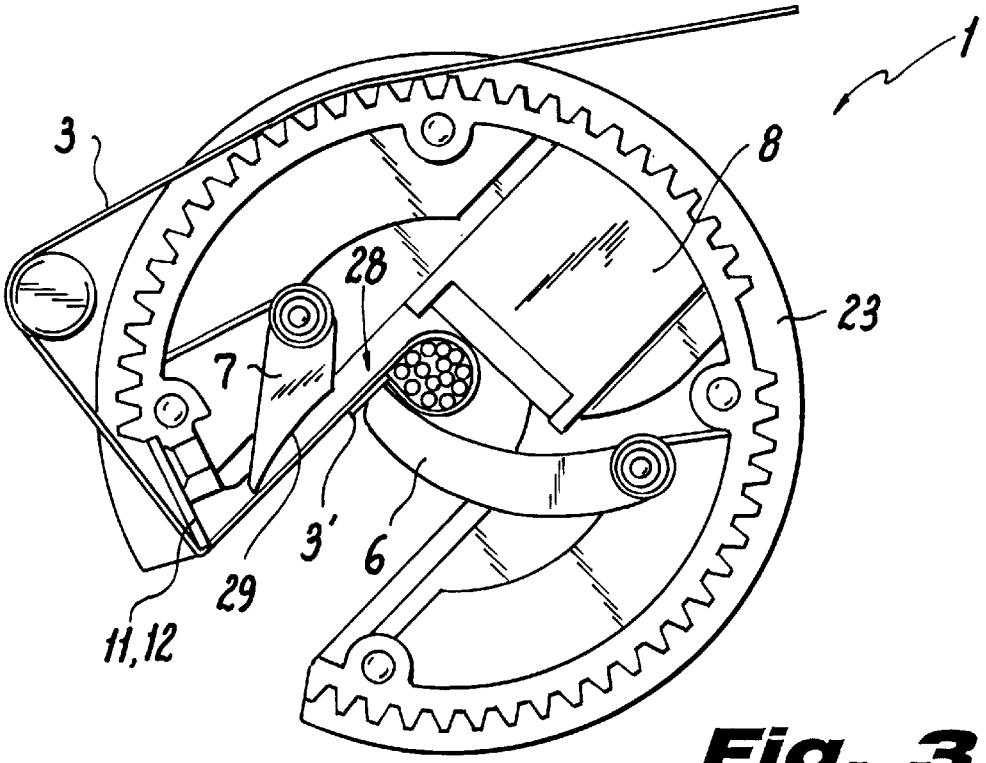
FIG. 3 is a side view of the inventive bundling head in a third position.
Figure 4:
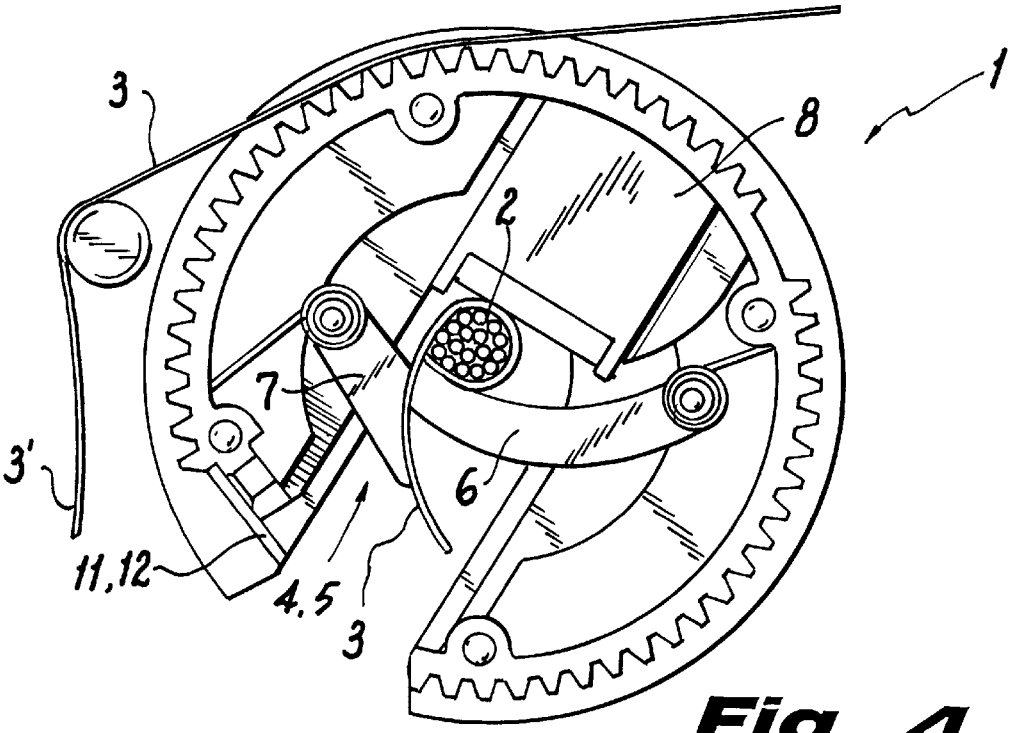
FIG. 4 is a side view of the inventive bundling head in a fourth position.

After the rotary movement of the bundling head 1 starts as shown in FIG. 3, the stationary cutter 12 of a cutting device 11 cuts the firmly tightened band 3 by rotating the bundling head 1, for example over 45° as shown in FIG. 4. The initial portion 3' of the band is pressed with the adhesive side 21 from the jaw region 28 of the first turning jaw 6 against the adhesive side 21 of the band 3. Thereby, the band 3 is first fixed around the objects 2. As a result, the second turning jaw 7 is laid by the spring 18 against the first turning jaw 6 so that the band is pressed by both turning jaws 6, 7 at opposite sides by the jaw regions 28, 29. Thereby a higher friction resistance and thereby a higher pulling force is provided by pressing the adhesive side 21 on the first turning jaw 6 by the second turning jaw 7. Thereby during a further rotation of the bundling head 1 a very tight wrapping of the band 3 around the objects 2 is provided.

The pulling force on the band 3 can be adjusted by the leg springs 17, 18. An adhesive layer rubbing off from the outer surface of the first turning jaw 6 is continuously worn away by the subsequent band (self cleaning effect).

As can be seen from FIG. 5, the device is provided with a band guide 22. The band guide is formed by two side parts 23 and 24 also shown in FIG. 1.

The toothed gear 14 and one of the side parts 23 can be formed as a one-piece element produced by an injection molding process. This one-piece element is screwed together with the other side part 24 as shown in FIG. 6.

FIG. 7 illustrates the utilization of the bundling head 1 for a device 27 for bundling elongated objects 2, in particular with an electrically driven hand device 13. A corresponding band supply receptacle is identified with reference numeral 25.

The hand device 13 has a handle H containing an electric motor M that drives gears G that are engaged with the toothed gear 14 to provide the rotary movement of the bundling head 1 as shown in FIG. 7.

It will be understood that each of the elements described above, or two or more together, may also find a useful application in other types of constructions differing from the types described above.

While the invention has been illustrated and described as embodied in bundling head for bundling elongated objects, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand-held bundling device for bundling elongated objects by wrapping the elongated objects with a one-side adhesive band, said bundling device comprising a handle (H) for an operator of the bundling device;

a bundling head (1) including means (4,5) for pressing the band against the elongated objects and for pulling the band tightly around the elongated objects;

means (14,G,M) for rotating a portion of the one-sided adhesive band together with the bundling head (1) around the elongated objects; and wherein said means (4,5) for pressing and pulling includes a spring-loaded displaceable central jaw (8) located in the bundling head (1) and a first spring-loaded turning jaw (6) and a second spring-loaded turning jaw (7) located in the bundling head (1) opposite one another with the central jaw between the turning jaws, said spring-loaded displaceable central jaw (8) is displaceable by insertion of the elongated objects into the bundling head and said spring-loaded turning jaws (6,7) are formed and positioned so that said spring-loaded turning jaws (6,7) engage said band on opposite sides of said band and slide over controlling slid surfaces (19,20) provided on the displaceable central jaw to wrap and tighten the band around the elongated objects.

2. The hand-held bundling device as defined in claim 1, wherein said spring-loaded displaceable jaw is provided with slippage securing means on a surface engaging said band.

3. The hand-held bundling device as defined in claim 2, wherein said slippage securing means comprise a rubber-like coating.

4. The hand-held bundling device as defined in claim 1, wherein the bundling head (1) comprises cutting means (11,12) for cutting said band after said band has been wrapped and tightened around said elongated objects by said turning jaws.

5. The hand-held bundling device as defined in claim 1, wherein said means for rotating the one-sided adhesive band together with the bundling head comprises a toothed gear (14) fixed in said bundling head (1).

6. The hand-held bundling device as defined in claim 5, wherein said means for rotating comprises an electric motor (M) in said handle (H) and gears (G) engaged with said electric motor and said toothed gear (14).

* * * * *